US006535807B2

(12) United States Patent
Christensen et al.

(10) Patent No.: US 6,535,807 B2
(45) Date of Patent: Mar. 18, 2003

(54) CONTROL SYSTEM FOR USE ON CONSTRUCTION EQUIPMENT

(75) Inventors: Steven V. Christensen, Peachtree City, GA (US); Brett J. Janson, East Peoria, IL (US); Rob E. Stone, Metamora, IL (US); Wayne J. Wulfert, East Peoria, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 09/906,380

(22) Filed: Jul. 16, 2001

(65) Prior Publication Data

US 2003/0014170 A1 Jan. 16, 2003

(51) Int. Cl.[7] ..... G01G 19/08; B60G 17/08; B60P 1/04

(52) U.S. Cl. ..... 701/50; 704/124; 340/611; 37/234

(58) Field of Search ..... 701/50, 124; 172/2, 172/6; 340/686.1, 611, 626, 685; 37/234, 902; 177/141, 136; 74/731.1, 732.1

(56) References Cited

U.S. PATENT DOCUMENTS

| | | | | | |
|---|---|---|---|---|---|
| 4,511,974 | A | * | 4/1985 | Nakane et al. | 364/463 |
| 4,839,835 | A | * | 6/1989 | Hagenbuch | 364/567 |
| 5,178,510 | A | * | 1/1993 | Hanamoto et al. | 414/694 |
| 5,528,843 | A | * | 6/1996 | Rocke | 37/348 |
| 6,087,945 | A | * | 7/2000 | Yasuda | 340/611 |
| 6,175,788 | B1 | * | 1/2001 | Hasegawa et al. | 701/29 |
| 6,266,594 | B1 | * | 7/2001 | Ishikawa | 701/50 |
| 6,275,757 | B1 | * | 8/2001 | Watanabe et al. | 701/50 |

* cited by examiner

*Primary Examiner*—Tan Q. Nguyen
*Assistant Examiner*—Dalena Tran
(74) *Attorney, Agent, or Firm*—R Carl Wilbur

(57) ABSTRACT

A control system for use in connection with control systems on construction equipment includes an electronic control module that records pressure sensor signals of a hydraulic pressure sensor and responsively determines whether the pressure sensor has failed.

15 Claims, 2 Drawing Sheets

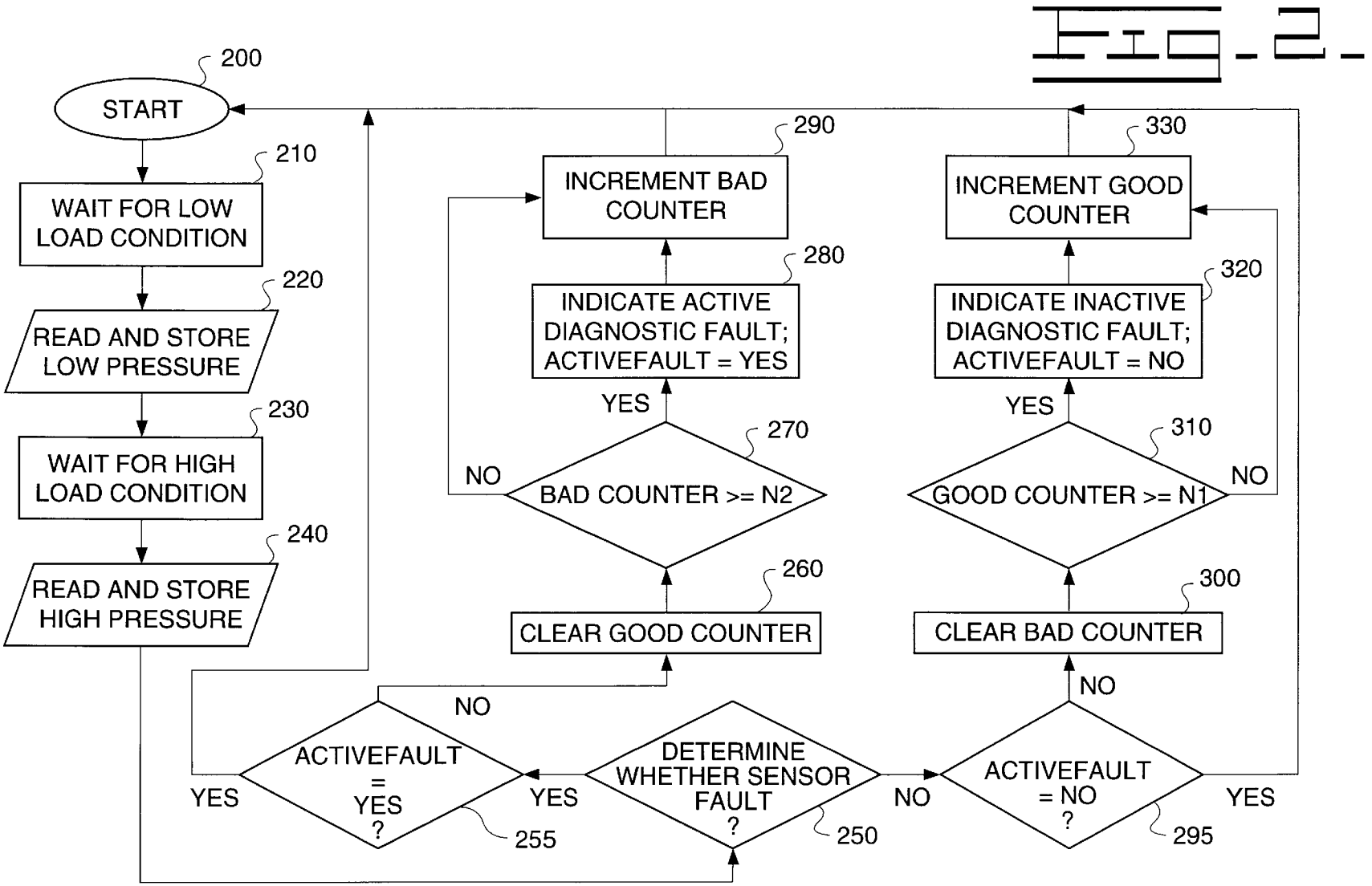
FIG-2
START
200
WAIT FOR LOW LOAD CONDITION
210
READ AND STORE LOW PRESSURE
220
WAIT FOR HIGH LOAD CONDITION
230
READ AND STORE HIGH PRESSURE
240
ACTIVEFAULT = YES ?
255
YES
NO
DETERMINE WHETHER SENSOR FAULT ?
250
YES
NO
CLEAR GOOD COUNTER
260
BAD COUNTER >= N2
270
NO
YES
INDICATE ACTIVE DIAGNOSTIC FAULT; ACTIVEFAULT = YES
280
INCREMENT BAD COUNTER
290
ACTIVEFAULT = NO ?
295
YES
NO
CLEAR BAD COUNTER
300
GOOD COUNTER >= N1
310
NO
YES
INDICATE INACTIVE DIAGNOSTIC FAULT; ACTIVEFAULT = NO
320
INCREMENT GOOD COUNTER
330

CONTROL SYSTEM FOR USE ON CONSTRUCTION EQUIPMENT

TECHNICAL FIELD

The present invention relates to construction equipment, and more particularly to a control system that monitors the health of a pressure sensor associated with the construction equipment.

BACKGROUND

Construction equipment often has several different systems that depend on the powerplant (typically an internal combustion engine) for power. Often these systems will include a hydraulic system to control various implements and a powertrain system to propel the machine. For example, on wheel loaders the powerplant must provide power to the powertrain to propel the machine and must provide power to the hydraulic system to control the bucket. Often these two systems require power simultaneously. For example when a wheel loader loads the bucket with material, the powertrain requires power to propel the machine into the pile of material, and the implement system requires power to lift the rock or soil. It is desirable to select a powerplant that can provide enough power to permit both systems to function efficiently when operating together. However, a powerplant with enough power to operate both systems at the same time could be capable of producing more power than necessary if only one of the systems was demanding power. In the past, some wheel loaders have simply used powertrains and implement systems that are able to withstand the full power output of the powerplant. However, this results in more expensive, heavier and generally less responsive powertrain.

In other prior art systems, there have been attempts to modify the power output of the engine based on powertrain and implement demands. In such systems, the power output of the engine is limited when there is no power required by the implement system. This in turn prevents the powerplant from producing more power than the powertrain is capable of receiving, without having to use the more expensive, heavier, less responsive powertrain. Although these systems have generally worked well there are drawbacks in the way they have attempted to determine the power demanded by the implement system, or the powertrain. Some systems have used pressure sensors to measure the hydraulic pressure provided to the implements and have determined the power demanded by the implement from that measurement. However, these systems are sometimes unable to detect when the sensors fail, especially if the sensor continues to produce what appears to be a valid signal. If the sensors fail and continue to produce an erroneous signal that otherwise appears valid, the control system will nevertheless use the signal to determine the maximum engine power output. These systems could then either produce too much power for the powertrain or inappropriately limit power output of the engine.

It would be preferable to have a fault tolerant control system, that could reliably determine whether the implement was demanding power from the powerplant.

SUMMARY OF THE INVENTION

An embodiment of the present invention includes a control system capable of generating a diagnostic fault in response to a failed hydraulic pressure sensor. Preferably the system determines the hydraulic pressure in a low load condition and then determines the hydraulic pressure in a high load condition. The system then evaluates the pressure sensor performance in response to the determined hydraulic pressures.

These and other aspects and advantages associated with the present invention will become apparent to those skilled in the art upon reading the following detailed description in connection with the drawings and appended claims.

BRIEF DESCRIPTION OF THE DRAWINGS

FIG. 2 is a flow chart of a preferred embodiment of software control associated with the present invention.

DETAILED DESCRIPTION

Figure 1:
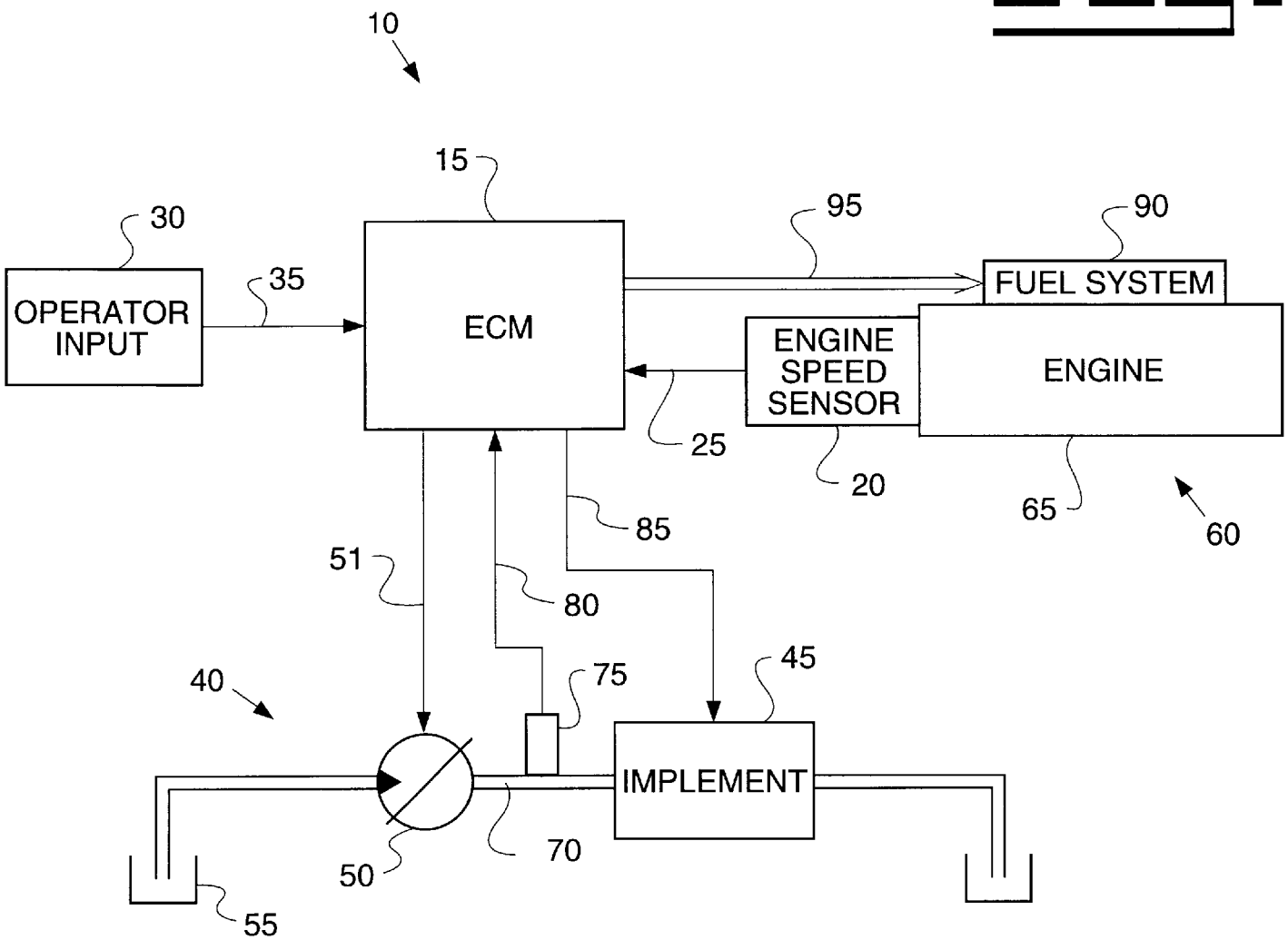
FIG. 1 is a system level block diagram of components associated with a preferred embodiment of the present invention.

The following is a detailed description of a preferred embodiment of the invention. The present invention is not limited to the specific embodiment disclosed herein, however, and includes all other embodiments and alternatives as may fall within the scope of the appended claims.

The present invention is used on equipment having an implement and a powertrain. The following detailed description discusses the invention in relationship to a wheel loader having a bucket and a powertrain. Although the present invention is described in connection with a wheel loader, those skilled in the art will recognize that the invention can be applied to other equipment that has power demands for both a powertrain and an implement system, without deviating from the scope of the present invention as defined by the appended claims.

Referring first to FIG. 1, a block diagram of various components of the control system 10 of the present invention is shown. As shown in the figure, the control system 10 preferably includes at least one electronic control module ("ECM") 15, connected with the various components. Although the ECM 15 is shown as a single block, those skilled in the art will recognize that the electronic control module may include a variety of components including a microprocessor or microcontroller, a data bus, an address bus, memory devices such as random access memory (RAM) and read only memory (ROM), power supply circuitry, and input and output signal conditioning circuitry to allow the microprocessor to communicate with devices outside the ECM 15. Moreover, in some applications there may be more than one ECM 15. In such systems each ECM 15 may be devoted to a specific subsystem. For example, in one embodiment of the present invention, a first ECM 15 may control the machine implements, a second ECM 15 may control a powerplant 60, and a third ECM 15 may control a powertrain (not shown). In such systems, the multiple ECMs will be interconnected by a databus or similar communication structure to permit the various ECMs and subsystems to communicate with one another. Throughout the remainder of this specification the term ECM 15 will be used to refer to one or multiple electronic control modules that practice the invention claimed herein.

Although FIG. 1 shows the various connections to each of the components are discrete connections, a preferred embodiment of the present invention utilizes a data/control bus to transfer signals and information between the electronic control module 15 and the various system components. Such data/control buses and the associated data transfer protocols are known in the art.

Referring again to FIG. 1, the ECM 15 is connected with an engine speed sensor 20, which produces an engine speed signal on connector 25. Also connected with the ECM 15 is an operator input 30 which produces signals on connector 35 indicative of desired movement of an implement. In a preferred embodiment, as applied to a wheel loader, the operator input 30 generally includes levers that control the tilt and lift motion of a bucket. In some cases the levers may control pilot valves that, in turn, control other valves which control the flow of hydraulic fluid flow to the lift and tilt cylinders of the implement. In other cases, the levers could be in the form of a joystick or other device that produces electrical signals that control valves, thereby controlling the flow of hydraulic fluid to the lift and tilt cylinders.

The control system 10 interfaces with a hydraulic system 40 on the machine. The hydraulic system 40 provides pressurized hydraulic fluid to the implements 45, which in the case of a wheel loader, include the lift and tilt cylinders. Included in the hydraulic system 40 is a variable displacement hydraulic pump 50, which is connected with a source of hydraulic fluid 55. The ECM 15 produces a signal on connector 51 which varies the angle of a swash plate (not shown) and thereby controls the output pressure of the pump 50. Although a preferred embodiment uses a variable displacement pump 50, those skilled in the art will recognize that it could be replaced with a suitable fixed displacement pump and associated valves to control the flow of fluid to the implements. When the operator wants the implement 45 to move, he will manipulate the operator input 30 thereby changing the signals on connector 35. The ECM 15 will produce an appropriate signal on connector 51 to cause the variable displacement pump 50 to increase the pressure of the hydraulic fluid provided to the implements 45.

The variable displacement hydraulic pump 50 is powered by a powerplant 60, which in a preferred embodiment is an internal combustion engine 65. The pump 50 provides a source of pressurized hydraulic fluid in conduit 70 to the implements 45. A pressure sensor 75 is, located on the output side of the pump 50 and produces a signal over connector 80 indicative of the pressure of the hydraulic fluid that is provided to the implements 45. The ECM 15 produces implement control signals over connector 85 which controls the flow of hydraulic fluid to the implements, through any of a number of known valves. The ECM 15 produces the control signals in response to signals received from the operator input 30, or in response to automated control signals generated by software in the ECM 15, or other operator inputs or signals that may generate movement of the implements.

The ECM produces fuel delivery signals to a fuel system 90 through connectors 95. Typically, the fuel system 90 includes fuel injectors that deliver fuel to individual engine cylinders based upon the timing and duration of the signal provided to that injector. The power output of the engine 65 is based, in part, on the fuel delivery signals. Typically, the ECM 15 will include fuel delivery maps, or formulas, for determining, fuel delivery to the engine 65 based on operator inputs, such as the throttle position, and other engine operating parameters. As is known to those skilled in the art, the ECM 15 can be programmed to reduce, or derate, the engine power output in response to certain inputs or operating conditions.

In the control system of the present invention, the ECM 15 will reduce, or derate the power output of the engine in response to a lack of power demand from the implements 45. For example, if the implements 45 are not demanding power, then the ECM 15 will derate the engine to prevent it from generating more power than the powertrain can handle. In a preferred embodiment of the present invention, the ECM 15 will input the pressure signal on connector 80 produced by the pressure sensor 75 to determine if the implements 45 are demanding power. If the implements 45 are not demanding power then the ECM 15 will derate the maximum power output of the engine 65. If the implements 45 are demanding some (but less than full) power, then the ECM 15 may derate the engine 65 power slightly. If the implements are demanding full power, then the ECM 15 generally will not derate the engine 65.

Determining whether the implements 45 are demanding power is an important factor in controlling the power output of the engine 65. Thus, in the configuration of the preferred embodiment described herein, it is important that the ECM 15 receive a pressure signal on connector 80 that is indicative of the true pressure at the output of the variable displacement hydraulic pump 50. While the pressure sensor 75 is generally reliable, it is possible to have it fail during operation. In some of these cases, the pressure sensor may continue to produce a pressure signal, although it generally will not accurately reflect the actual pressure at the pump 50 output.

Referring now to FIG. 2, a flow chart of software control performed in connection with a preferred embodiment of the present invention is shown. The software causes the ECM 15 to monitor the pressure signal on connector 80 during operation of the equipment and determine whether the pressure sensor 75 has failed. Program control begins at block 200 and passes to block 210.

In block 210 the ECM 15 determines whether the implements 45 are in a low load condition by determining whether the implements 45 are demanding less than a predetermined amount of power. In a preferred embodiment, the ECM 15 makes this determination as a factor of the operator inputs 30 or ECM generated commands to the implement 45 and the engine speed signal produced on connector 25. If the operator inputs indicate that the operator is not commanding motion from the implements and the engine speed is more than a predetermined value, then the system is in a low load condition. In a preferred embodiment, the ECM 15 will verify that the implements are idle for a predetermined period of time, for example, 2 seconds, and then determine whether the engine is in a low load condition. As is known to those skilled in the art, operator inputs and sensor inputs must have stabilized for a predetermined period of time to prevent signal noise or other transients from being misinterpreted as a low load condition. Program control passes from block 210 to block 220.

In block 220, the ECM 15 stores a pressure signal produced by the pressure sensor 75. Program control then passes to block 230.

In block 230, the ECM 15 determines whether the system is in a high load condition. In a preferred embodiment, the ECM 15 makes this determination as a factor of the operator inputs 30 and engine speed signal produced on connector 25. If the operator inputs indicate that the operator is commanding motion from the implements and the engine speed is below a predetermined value, then the system is in a high load condition. In a preferred embodiment, these inputs must exist for a predetermined period of time to prevent signal noise or other transients from being misinterpreted as a high load condition. If the ECM 15 determines that the system is in a high load state, program control passes to block 240.

In block 240, the ECM stores a pressure signal produced by the pressure sensor 75. Program control passes to block 250.

When program control reaches block 250, software control has passed through block 220 and block 240 in which case the ECM 15 has stored a pressure value associated with a high load condition and a pressure value associated with a low load condition. Then in block 250, the ECM 15 preferably calculates a difference between the pressure values and compares that difference to a predetermined value. Because the difference in pressure between a low load state and a high load state should be greater than the predetermined value, this calculation is a prediction of whether the sensor is operating properly. If the difference between the high load state and the low load state is less than a predetermined value, then the ECM 15 concludes that there is a fault and program control passes to block 255. Otherwise, if the ECM concludes that there is no sensor fault, then program control passes to block 295.

In block 255, the control determines whether an active fault already exists, preferably by checking to see whether a variable, ACTIVEFAULT, is set to YES. If the ACTIVEFAULT variable is set to YES then the program has already set an Active Diagnostic Fault in block 280 (described in more detail below) for the fault. In this case program control returns to block 200. Otherwise, if the variable ACTIVEFAULT is set to NO then program control passes to block 260.

In block 260, the ECM 15 clears a good counter. The good counter is preferably a register in memory of the ECM 15 that counts how many consecutive calculations of the difference between the high load state and the low load state have exceeded the predetermined value; i.e. how many consecutive calculations have indicated a good sensor. Program control then passes to block 270.

In block 270, the ECM 15 compares the number stored in a fault counter against a predetermined value N2. In a preferred embodiment, N2 is five. If the number of consecutive faults exceeds the predetermined value N2, then program control passes to block 280. Otherwise, program control passes to block 290.

In block 280, the ECM 15 records a diagnostic fault related to the pressure sensor 75 and sets the variable ACTIVEFAULT to YES. Program control then passes to block 290. In block 290, the ECM 15 increments the bad counter. Program control then returns to block 200.

Returning to block 250, if the ECM determines that there has not been a sensor fault then program control passes to block 295. As described above, the ECM preferably makes this determination by comparing the calculated difference between the high load condition and the low load condition with a predetermined value. If the calculated difference is greater than the predetermined value, then the ECM 15 concludes that sensor 75 is operating properly.

In block 295, the control determines whether an inactive fault already exists, preferably by checking to see whether a variable, ACTIVEFAULT, is set to NO. If the ACTIVEFAULT variable is set to NO then the program has already cleared the Active Diagnostic Fault in block 320 (described in more detail below). In this case program control returns to block 200. Otherwise, if the variable ACTIVEFAULT is set to YES then program control passes to block 300.

In block 300, the ECM 15 clears the bad counter. The bad counter is a register stored in memory of the ECM 15 that stores a value representative of the number of consecutive calculations of the difference between the high load state and the low load state having been less than the predetermined value. Thus the bad counter is a register that stores the number of calculated differences that are indicative of a sensor that has failed. From block 300, program control passes to block 310.

In block 310, the ECM 15 compares the number stored in the good counter with a predetermined value N1. If the good counter exceeds the predetermined value, then program control passes to block 320, otherwise program control passes to block 330.

In block 320, the ECM clears the diagnostic fault related to the pressure sensor. Program control then passes to block 330.

In block 330, the ECM increments the value stored in the good counter. Program control then returns to block 200.

Industrial Applicability

In the foregoing manner, a preferred embodiment is able to monitor the pressure sensor 75 signal at times when the signal should have values that differ by more than a predetermined amount. In a preferred embodiment, the ECM 15 monitors and records the pressure sensor signal at high load and low load conditions. If the difference between the high load signal and the low load signal is less than a predetermined amount, then the ECM 15 increments a counter. When the number of consecutive faults exceeds a predetermined value N2, the ECM 15 records a diagnostic fault indicating that the pressure sensor 75 has failed. In this manner, a preferred embodiment of the present invention allows service personnel to quickly and accurately diagnose a pressure sensor failure.

What is claimed is:

1. A method for determining the operation of a pressure sensor on construction equipment having implements and a powertrain powered by an engine, said method including:

determining when said implements are in a low load condition and responsively measuring a first output of said pressure sensor;

determining when said implements are in a high load condition and responsively measuring a second output of said pressure sensor; and evaluating the operation of the pressure sensor in response to said first output and said second output.

2. The method according to claim 1, including:

determining a difference between said first output and said second output and incrementing a fault counter in response to said difference being less than a predetermined value.

3. The method according to claim 2, including:

registering a fault code in response to said fault counter exceeding a predetermined value.

4. The method according to claim 1, wherein said step of determining that the implement is in a low load condition includes inputting an operator implement control input.

5. The method according to claim 4, wherein said implement control input includes an implement lift lever control.

6. The method according to claim 5, wherein said implement control input includes an implement tilt lever control.

7. The method according to claim 4, wherein said implement control input includes an ECM directed command.

8. The method according to claim 4, wherein said step of determining that the implement is in a low load condition includes determining an engine speed.

9. The method according to claim 8, wherein said implement control input includes an implement lift lever control.

10. The method according to claim 1, wherein said step of determining that the implement is in a low load condition includes inputting an engine speed signal.

11. A method for determining the operation of a pressure sensor associated with a hydraulic system powering an implement on construction equipment, said construction equipment having a powertrain, said powertrain and said hydraulic system being powered by an engine, said method including:

determining when said implement is in a low load condition and responsively measuring a first output of said pressure sensor;

determining when said implement is in a high load condition and responsively measuring a second output of said pressure sensor;

determining that the pressure sensor is inoperative in response to said first output and said second output; and limiting power output of said engine in response to said step of determining that the pressure sensor is inoperative.

12. A control system for use with construction equipment, said construction equipment having a hydraulically powered implement and a powertrain, and an engine providing power to said hydraulically powered implement and said powertrain, said control system including:

a pump associated with the engine, said pump providing hydraulic pressure for use by said implement;

a pressure sensor associated with an output of said pump, said pressure sensor producing a signal indicative of the pressure of the hydraulic fluid;

an implement control, said control producing a signal indicative of a desired motion of said implement;

an engine speed sensor, said engine speed sensor producing a signal indicative of the rotational velocity of the engine;

an electronic control module connected with said pressure sensor, said implement control and said engine speed sensor, wherein said electronic control module reads a low load pressure signal from said pressure sensor, and a high load pressure signal from said pressure sensor and produces and fault code as a function of said low load pressure signal and said high load pressure signal.

13. The control system of claim 12, wherein said electronic control module produces said fault code as a function of a difference between said high load pressure signal and said low load pressure signal exceeding a predetermined value.

14. The control system of claim 13, wherein said electronic control module produces said fault code in response to said difference between said high load pressure signal and said low load pressure signal exceeding said predetermined value a predetermined number of times.

15. The control system according to claim 14, wherein said electronic control module limits the engine power in response to said fault code.

* * * * *